United States Patent [19]

Swan et al.

[11] 4,335,595

[45] Jun. 22, 1982

[54] PADDLE LOCK WITH HANDLE DISCONNECT

[75] Inventors: Jye P. Swan, Brunswick Hills; John V. Pastva, Jr., Parma Hts.; Donald J. Dignan, South Euclid, all of Ohio

[73] Assignee: The Eastern Company, Cleveland, Ohio

[21] Appl. No.: 108,016

[22] Filed: Dec. 28, 1979

[51] Int. Cl.[3] ..... E05B 55/06; E05C 1/12

[52] U.S. Cl. ..... 70/149; 70/218; 70/472; 70/489; 292/173; 292/DIG. 27; 292/DIG. 31

[58] Field of Search ..... 70/472, 488, 489, 149, 70/204, 218, 221–224, 416; 292/167, 173, 226, 223, DIG. 27, DIG. 31, DIG. 37

[56] References Cited

U.S. PATENT DOCUMENTS

| | | | |
|---|---|---|---|
| 95,507 | 10/1869 | Petre | 292/DIG. 27 X |
| 2,453,505 | 11/1948 | Fornwald | 70/149 X |
| 3,782,141 | 1/1974 | Doerrfeld | 292/DIG. 31 X |
| 4,116,027 | 9/1978 | Tannery | 70/472 |
| 4,138,869 | 2/1979 | Pelcin | 292/DIG. 31 X |
| 4,170,119 | 10/1979 | Kalis, Jr. | 70/149 X |

*Primary Examiner*—William E. Lyddane
*Attorney, Agent, or Firm*—David A. Burge Co.

[57] ABSTRACT

A door lock has a flush-mountable body. A forwardly facing recess is defined by the body. A paddle-type handle is pivotally carried by the body and is movable between a nested position within the body recess and an operating position. A spring-projected slide bolt is carried on the back of the body and is movable between projected and retracted positions. A key-controlled disconnect linkage is provided for selectively connecting and disconnecting the handle and the bolt. The disconnect linkage includes a disconnect member which extends longitudinally along one side of the bolt and which has an end region that is shifted from side to side between connecting and disconnecting positions by a key-operated locking member. When the disconnect linkage drivingly connects the handle and the bolt, movement of the handle from its nested position to an operating position will cause corresponding retracting movement of the bolt. When the disconnect linkage disconnects the handle from the bolt, movement of the handle is inoperative to cause retracting movement of the bolt. A feature of the disconnect linkage is that it provides the lock with a "slam" capability, meaning that when the bolt is projected, it can be slammed into latching engagement with a suitably configured strike regardless of whether the disconnect linkage is drivingly connecting or disconnecting the handle and the bolt.

39 Claims, 14 Drawing Figures

PADDLE LOCK WITH HANDLE DISCONNECT

CROSS-REFERENCE TO RELATED APPLICATIONS

PADDLE LOCKS WITH HANDLE DISCONNECT FEATURES, Ser. No. 108,007 filed concurrently herewith on Dec. 28, 1979 by John V. Pastva, Jr., hereinafter "Disconnect Case I."

PADDLE LOCK WITH PIVOTALLY MOUNTED HANDLE DISCONNECT MEMBER, Ser. No. 108,010 filed concurrently herewith on Dec. 28, 1979 by Albert L. Pelcin, hereinafter "Disconnect Case II."

PADDLE LOCK WITH BOLT-CARRIED HANDLE DISCONNECT MEMBER, Ser. No. 107,859 filed concurrently herewith on Dec. 28, 1979 by John V. Pastva, Jr. and Albert L. Pelcin, hereinafter "Disconnect Case III."

PADDLE LOCK WITH ROTATABLY-MOUNTED HANDLE DISCONNECT MEMBER, Ser. No. 108,017 filed concurrently herewith Dec. 28, 1979 by James A. Reed and Edwin W. Davis, hereinafter "Disconnect Case IV."

PADDLE LOCK WITH TRANSLATABLY-MOUNTED HANDLE DISCONNECT MEMBER, Ser. No. 108,015 filed concurrently herewith Dec. 28, 1979 by Edwin W. Davis, hereinafter "Disconnect Case V."

PADDLE LOCK WITH GUARD-PROTECTED HANDLE DISCONNECT MEMBER, Ser. No. 107,858 filed concurrently herewith on Dec. 28, 1979 by Edwin W. Davis, hereinafter "Disconnect Case VII."

FLUSH-MOUNTABLE LOCK WITH ACTUATOR DISCONNECT FEATURE, Ser. No. 108,011 filed concurrently herewith on Dec. 28, 1979 by Edwin W. Davis, hereinafter "Disconnect Case VIII."

The present application and the applications cross-referenced above have been assigned to a common entity, The Eastern Company, a corporation of Connecticut.

BACKGROUND OF THE INVENTION

1. Field of the Invention

The present invention relates generally to a door lock having a spring-projected slide bolt, a handle for retracting the bolt, and a key control for selectively permitting and preventing the handle from retracting the bolt. More particularly, the invention relates to a lock of this type including a key-controlled disconnect linkage for selectively drivingly connecting and disconnecting the handle and the bolt, whereby the handle is, at all times, freely movable between normal and operating positions, but is functional only when the key control is "unlocked" to enable the handle to retract the bolt.

While the present invention has particularly advantageous use in conjunction with flush-type door locks used on swinging doors of vehicles, industrial cabinets, electrical equipment enclosures and the like, principles of the invention are not limited in application to such uses.

2. Prior Art

Flush-type door locks including a body, a lock bolt slidably carried on the body, and an operating handle for moving the bolt relative to the body are well known. Normally the handle is in a flush or nested position when the bolt is projected. Bolt retraction is effected by pivoting the handle to an operating position. Locks of this type are well suited for use on swinging doors of vehicles such as trucks, on merchandise, tool and equipment cabinets, electrical equipment enclosures and the like.

Flush-type, paddle-handle door locks employing key-operated rotatable cams for selectively permitting and preventing unlocking movements of operating handles, and having spring-projected slide bolts, are described in U.S. Pat. Nos. 3,707,862, and 3,668,907 granted Jan. 2, 1973 and June 13, 1972, respectively, to John V. Pastva, Jr. An ornamental appearance employed in locks of this general type is illustrated in U.S. Design Pat. No. 230,132 issued Jan. 29, 1974 to John V. Pastva, Jr.

The provision of a handle disconnect feature in a door lock is desirable in that the presence of such a feature will lessen, if not totally eliminate, incidents of these locks being damaged by would-be intruders. Since the handles of most previously proposed door locks are restrained from moving when the locks are locked, it is common for would-be intruders to attempt to gain entry by applying excessive leverage force to the lock handles. Where handle disconnect features are provided, the lock handles may always be moved freely, but are functional to retract the lock bolts only when the locks are "unlocked." Locks having handle disconnect features can be made practically entryproof short of the application of such forces as will totally destroy the locks.

Door locks employing various types of handle disconnect systems have been proposed. Prior proposals have, however, suffered from a variety of drawbacks including complexities of construction; failures to mount all of the operating parts of a lock on a single body member so that the resulting locks form compact, easy to install units; and, inappropriately configured parts of sizes and shapes that prohibit installation of locks embodying such proposals in conventionally configured door lock mounting openings.

3. The Cross-Referenced Disconnect Cases

The present invention and the inventions described in the several referenced Disconnect Cases represent the work products of a continuous and continuing development program which began nearly a decade ago.

The several handle disconnect systems described in the referenced Disconnect Cases were developed by co-workers operating, in some instances independently, and in other instances jointly, as is reflected in the naming of sole and joint inventors. Many of the disconnect system features claimed in separate ones of the referenced Disconnect Cases were developed substantially concurrently.

Where a claim in one of the referenced Disconnect Cases is found to be generic to a development concept utilized in another of these cases, it should be understood that care has been taken to present the generic claim in the case which describes the earliest development of a species that will support the generic claim. In this manner, a careful effort has been made to establish clear lines of demarcation among the claimed subjects matter of this and the several referenced Disconnect Cases. No two of these cases include claims of identical scope.

SUMMARY OF THE INVENTION

The present invention overcomes the foregoing and other drawbacks of the prior proposals by providing a novel and improved, reliable and durable, handleoperated door lock which includes a simple but effective key-controlled disconnect linkage for selectively drivingly connecting and disconnecting an operating handle and a spring-projected slide bolt.

A door lock embodying principles of the present invention preferably includes a support structure or body having side and back walls which cooperate to define a forwardly-facing recess. A bolt is slidably supported on the body at a location behind the back wall. The bolt is movable between projected and retracted positions with respect to the body, and a compression coil spring biases the bolt toward its projected position. A handle is supported on the body for swinging movement between a nested position and an operating position.

A key-controlled disconnect linkage has a locking member which is movable between locked and unlocked positions. A disconnect member is moved by the locking member between positions wherein the disconnect member selectively drivingly connects and disconnects the handle and the bolt. When the locking member is in its locked position, the disconnect member disconnects the handle and the bolt such that movement of the handle will cause no corresponding movement of the bolt. When the locking member is in its unlocked position, the disconnect member is operable to drivingly connect the handle and the bolt such that, when the handle is moved out of its nested position to an operating position, the bolt is retracted.

The disconnect linkage includes several improvements over previously proposed handle disconnect systems. It includes a disconnect member of generally L-shaped configuration having a relatively long leg which extends longitudinally alongside the bolt, and a relatively short leg which extends into a receiving formation provided in the bolt where the short leg may be engaged by the handle. An end of the long leg is engageable by a key-operated locking member for moving at least a portion of the long leg laterally relative to the bolt between connecting and disconnecting positions. Interengageable formations are provided on the bolt and on the long leg of the disconnect member. When the disconnect member is in its connecting position, the interengageable formations engage to provide a driving connection between the handle and the bolt. When the disconnect member is in its disconnect position, the interengageable formations disengage and provide no driving connection between the handle and the bolt.

A feature of locks embodying the preferred practice of the present invention is that conventional lock bodies and handles may be utilized thereby giving these locks substantially the same dimensional configurations as previously proposed locks which had no handle disconnect features. Moreover, since the disconnect functions of these locks are carried out principally at shielded locations within their slide bolt housings, the locks are not significantly different in appearance from previously proposed paddle locks which had no handle disconnect features.

As will be apparent from the foregoing summary, a feature of the present invention lies in the provision of a novel and improved door lock with a key-controlled disconnect system for selectively drivingly interconnecting and disconnecting the handle and the bolt.

These and other features and a fuller understanding of the present invention may be had by referring to the following detailed description and claims taken in conjunction with the accompanying drawings.

DESCRIPTION OF THE PREFERRED EMBODIMENT

Figure 1:
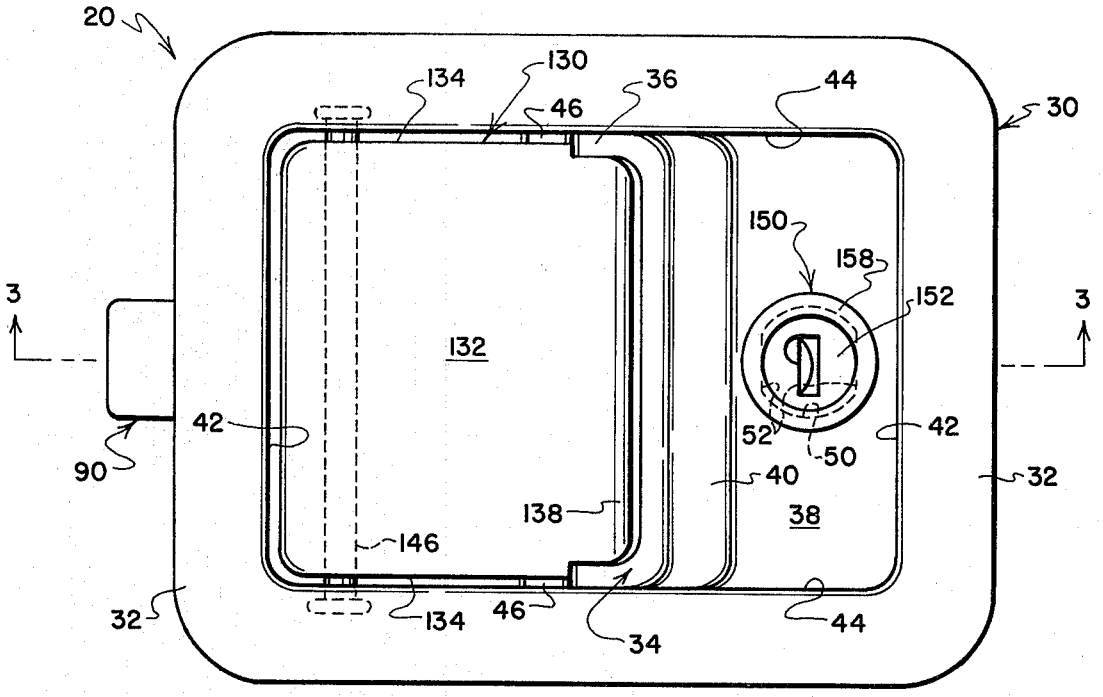
FIG. 1 is a front side elevational view of a lock embodying the present invention, the components of the lock being positioned in an unlocked attitude, with the handle nested and the bolt projected.

Referring to FIGS. 1–10, one embodiment of a key-controlled, paddle-handle, flush-mountable lock including features of the present invention is indicated generally by the numeral 20. The lock 20 is adapted to be supported on such structures as a swinging door (not shown) for relative movement therewith to bring the lock 20 into and out of juxtaposition with a suitably configured conventional strike (not shown) supported on a door frame or other structure (not shown). The manner in which locks of this general type are mounted on doors is well known to those skilled in the art. The mounting of such locks is described and illustrated in such patents as Pastva, Jr., U.S. Pat. No. 3,668,907.

In general, the lock 20 includes a recessed body 30 having a bolt housing 60 welded to the rear side of the body 30. The bolt housing 60 and the back wall of the body 30 cooperate to define an elongate passage 70. A bolt 90 is slidably carried in the passage 70 for movement between retracted and projected positions. A compression coil spring 110 biases the bolt 90 toward its projected position. A paddle handle 130 is pivotally carried on the body 30 for movement between nested and operating positions. A key control 150 and a disconnect member 180 are provided for selectively drivingly interconnecting and disconnecting the handle 130 and the bolt 90. A compression coil spring 250 is interposed between the bolt 90 and the disconnect member 180 for biasing the disconnect member 180 leftwardly, relative to the bolt 90, as viewed in FIG. 3.

The body 30 is a rectangular, pan-shaped metal stamping having a perimetrically extending flange 32 which surrounds a forwardly facing recess 34. Left and right back wall portions 36, 38 define levels of different depths in opposite end portions of the recess 34. An inclined back wall portion 40 interconnects the left and right back wall portions 36, 38. Forwardly extending end walls 42 and side walls 44 connect the back wall portions 36, 38, 40 with the flange 32.

Other features of the body 30 include a pair of stops 46 formed in the left back wall portion 36. The stops 46 project into the recess 34 at locations near the side walls 44, and are engaged by the handle 130 when the handle 130 is in its nested position. An elongate slot 48 is provided in the left back wall portion 36 at a location overlying the bolt 90. A hole 50 is formed through the right back wall portion 38. Opposite sides of the hole 50 have flat, parallel-extending surfaces 52. Aligned holes 54 are formed through the side walls 44 near their left ends.

The bolt housing 60 is a channel-shaped sheet metal stamping having a bottom wall 62, a pair of opposed side walls 64, an end wall 66, and a pair of mounting flanges 68. The flanges 68 overlie and are welded to the rear side of the left back wall portion 36.

Figure 3:
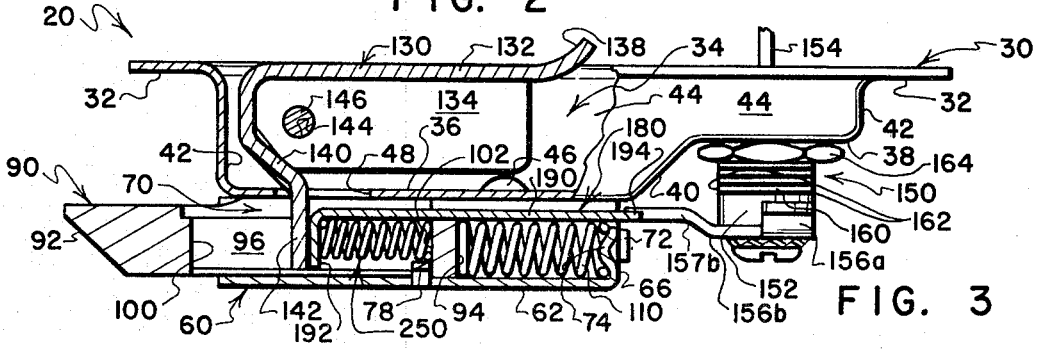
FIG. 3 is a bottom plan view with portions broken away and shown in cross-section as seen from a plane indicated by a line 3—3 in FIG. 1, with the components of the lock positioned as shown in FIG. 1.
Figure 4:
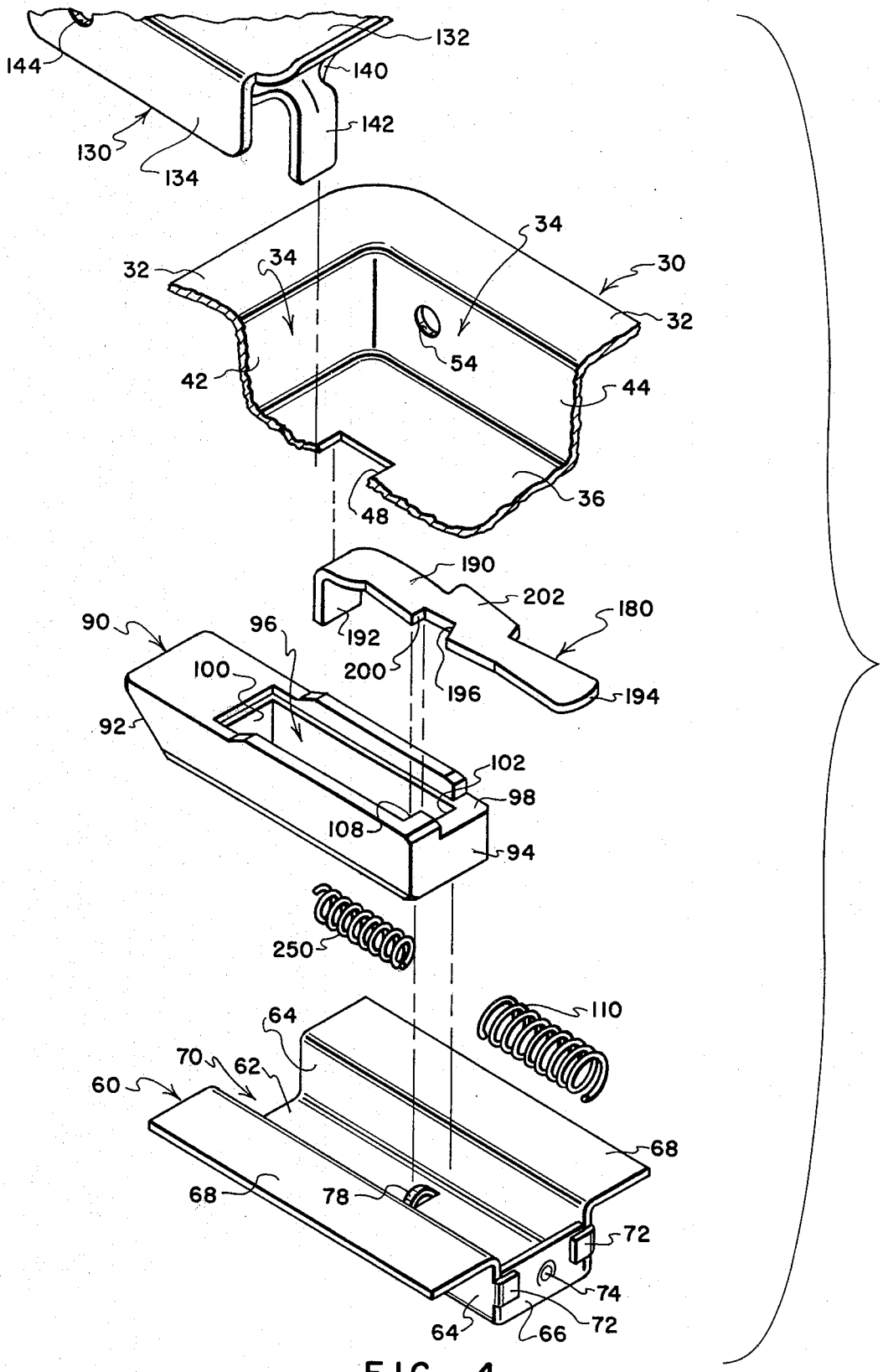
FIG. 4 is an exploded perspective view of portions of the lock of FIG. 1.

The bolt housing 60 cooperates with the left back wall portion 36 to define the passage 70 within which the bolt 90 is guided for sliding movement. The end wall 66 is formed as an integral part of the bottom wall 62, and operates to close a majority of the area of the right end of the bolt passage 70. As is best seen in FIG. 3, the end wall 66 stops short of the rearward surface of the left back wall portion 36, permitting the disconnect member 180 to be slidably carried therebetween. The side walls 64 have a pair of integrally formed locking tabs 72 which are folded to overlie the end wall 66 to reinforce the end wall 66. A dimple 74 is formed at a central location on the end wall 66. An inwardly extending stop formation 78 projects upwardly from the bottom wall 62, as is best seen in FIG. 4. The stop formation 78 is formed as an integral part of the bottom wall 62.

Referring to FIG. 4, the bolt 90 is a solid metal member which can be formed by conventional casting or powder metallurgy techniques. The bolt 90 has a generally rectangular cross section which corresponds to that of the passage 70. The bolt 90 has a tapered left end 92 configured, as is conventional, to permit the bolt 90 to be retracted in response to slamming engagement with a suitably configured strike (not shown). The bolt 90 has a flat right end 94. The bolt 90 has a receiving formation which preferably takes the form of an elongate slot 96 provided in the central part of the bolt 90. The bolt slot 96 has left and right end walls 100, 102 at its opposite ends.

An upper corner portion of the bolt 90 near the right end 94, as designated by the numeral 98 in FIG. 4, is of reduced height. The disconnect member 180 rests atop the corner portion 98. A portion of the right end 102 of the slot 96 extends upwardly beyond the height of the corner portion 98 and defines what will be referred to as an abutment surface 108.

Figure 5:
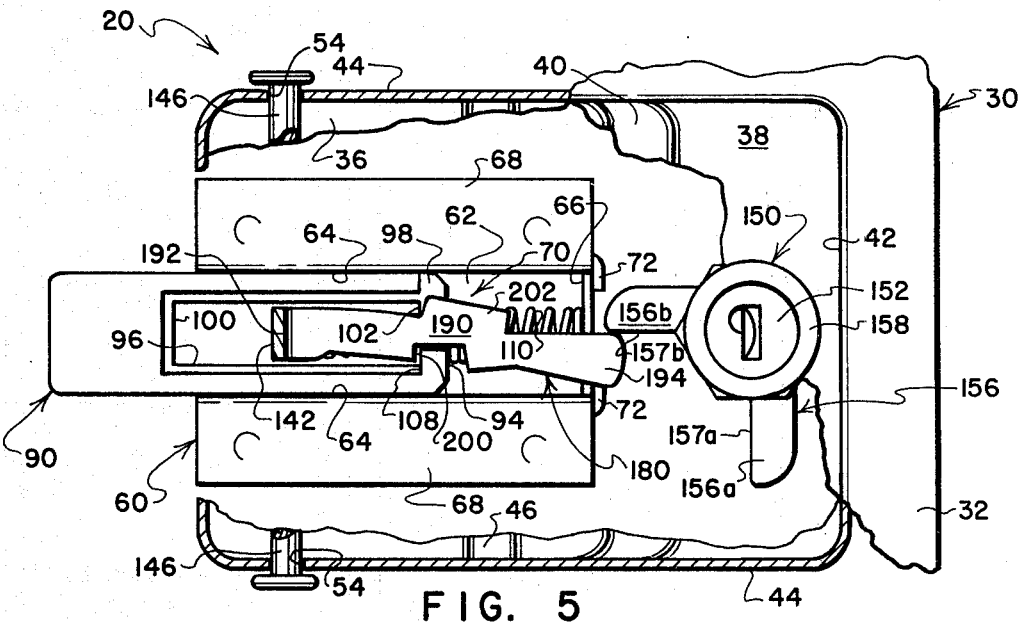
FIG. 5 is a front side elevational view similar to FIG. 1 with portions of the lock broken away to permit underlying components to be viewed, with the components of the lock positioned as shown in FIG. 1.
Figure 6:
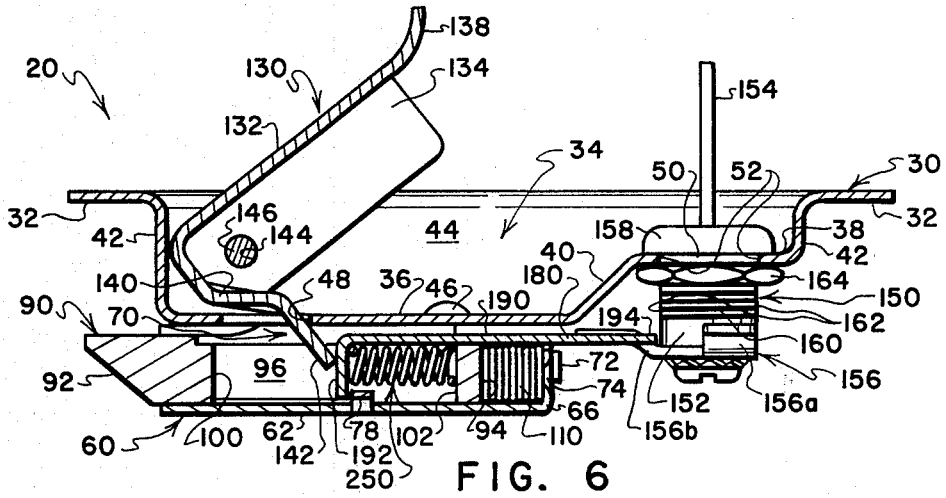
FIG. 6 is a sectional view similar to FIG. 3 with the components of the lock being positioned in an unlocked attitude, with the handle extended to an operating position and the bolt retracted.
Figure 7:
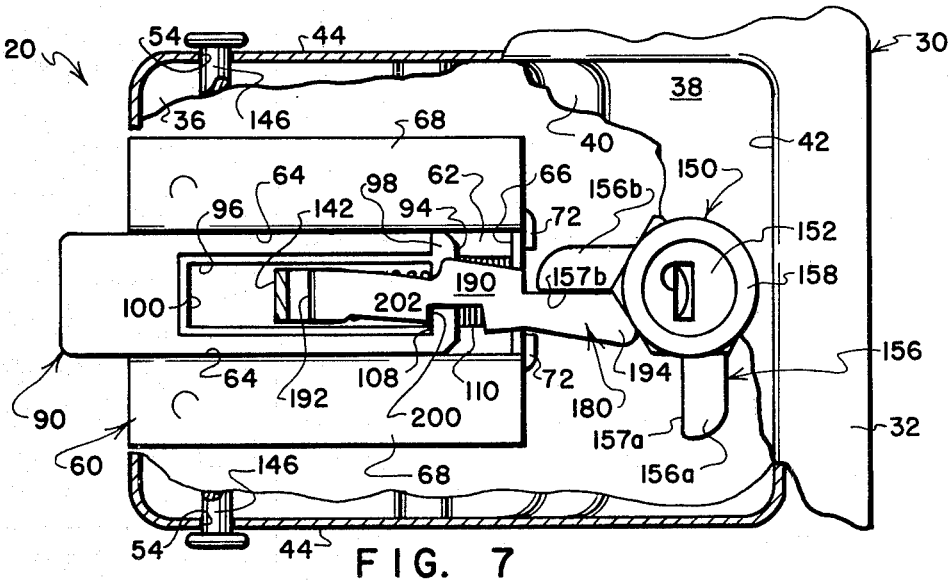
FIG. 7 is a front side elevational view similar to FIG. 5 with the components of the lock being positioned as shown in FIG. 6.

The bolt 90 is movable between a projected or latching position, shown in FIGS. 1–3, 5, and 8–10, and a retracted or unlatching position shown in FIGS. 6 and 7. When the bolt 90 is projected, its tapered left end 92 extends beyond the left edge of the body flange 32. When the bolt 90 is retracted, its tapered left end 92 extends substantially evenly with the left edge of the body flange 32.

The compression coil spring 110 is positioned in the passage 70. The spring 110 has a left end which engages the bolt end 94, and a right end which engages the bolt housing end wall 66. The dimple 74 extends into the right end of the spring 110 to help retain the spring 110 in place. The spring 110 biases the bolt 90 leftwardly toward its projected position, and is compressed to progressively greater degrees as the bolt 90 is retracted.

The paddle handle 130 is a sheet metal stamping having a generally rectangular, substantially flat plate portion 132 and a pair of opposed, inwardly-turned side flanges 134. An outwardly-turned gripping flange 138 is provided at the right end of the handle 130, and an inwardly-turned operating flange 140 is provided at the left end. An operating arm 142 is formed as an integral projection of the operating flange 140.

The handle 130 has aligned mounting holes 144 formed through its side flanges 134. A headed pin 146 extends through the body holes 54 and through the handle mounting holes 144 to pivotally mount the handle 130 on the body 30 at a location between the body side walls 44.

Figure 2:
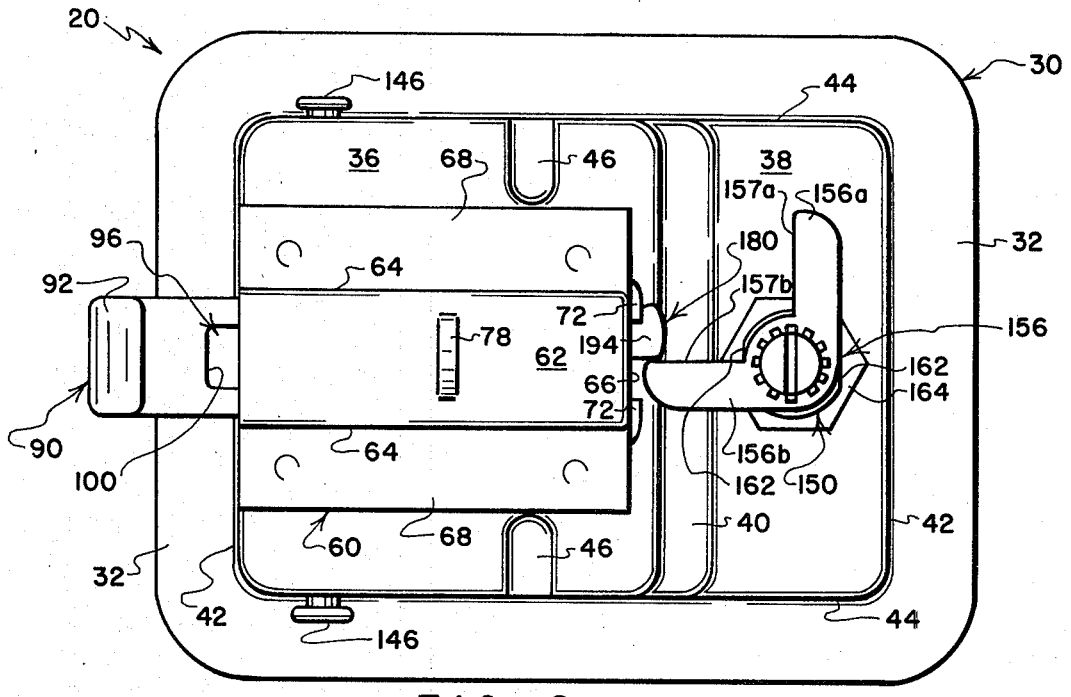
FIG. 2 is a rear side elevational view of the lock of FIG. 1 with the components of the lock positioned as shown in FIG. 1.

The handle operating arm 142 extends through the back wall slot 48 and into the bolt slot 96. When the handle 130 is in its normal nested position, as shown in FIGS. 1–3, the spring 110 biases the bolt 90 leftwardly toward a position where the right end wall 102 of the bolt slot 96 engages the bolt housing stop formation 78. At the same time, the spring 250 biases the disconnect member 180 leftwardly into engagement with the operating arm 142 and, in turn, biases the handle 130 clockwise, as viewed in FIG. 3, to maintain the handle side flanges 134 in engagement with the bottom wall stops 46.

Figure 8:
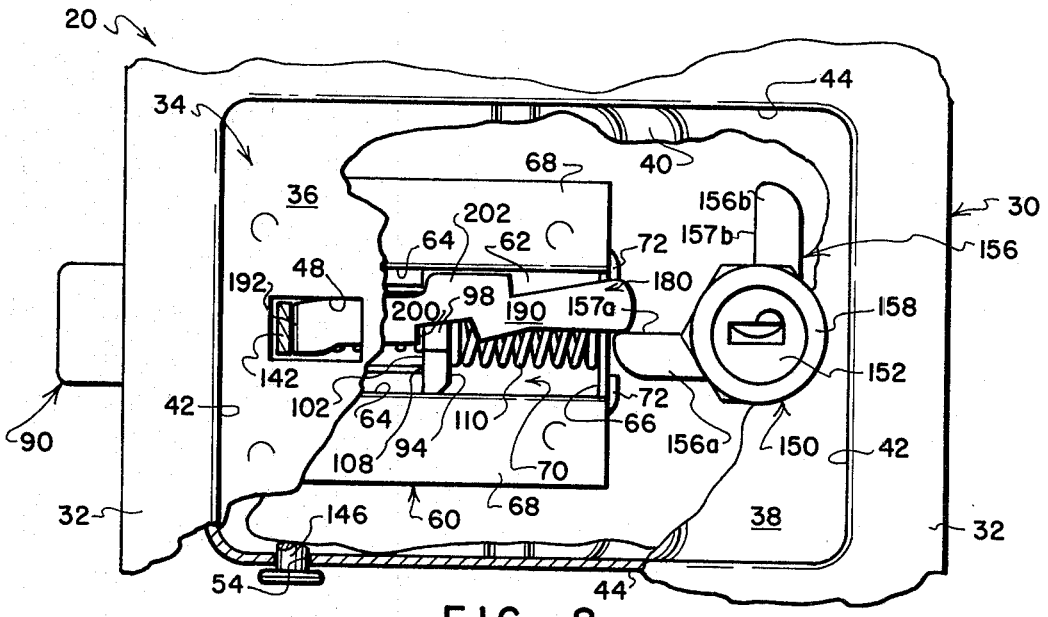
FIG. 8 is a front side elevational view similar to FIG. 5 with the components of the lock being positioned in a locked attitude, with the handle nested and the bolt projected.
Figure 9:
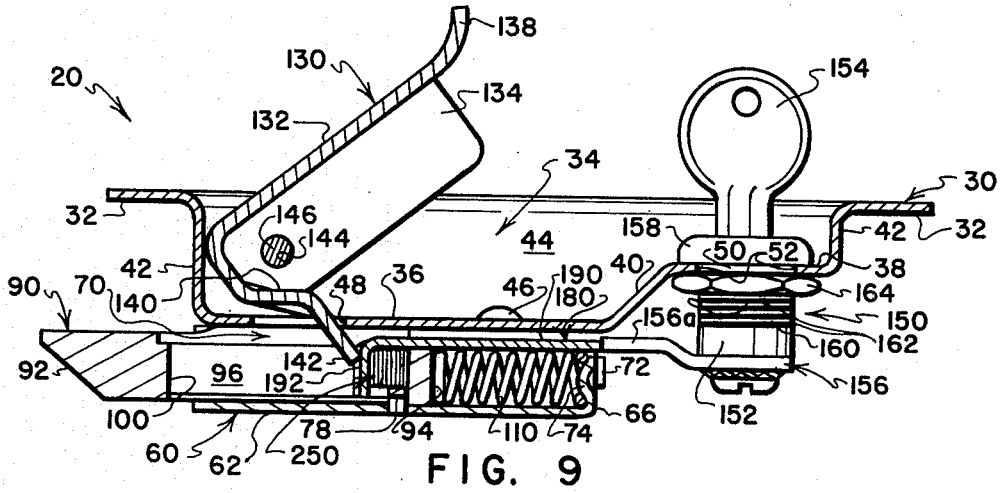
FIG. 9 is a sectional view similar to FIG. 6 with the components of the lock being positioned in a locked attitude, with the handle extended to an operating position and with the bolt nonetheless still in its projected position.

When the handle 130 is moved out of its nested position to an operating position by pivoting it counterclockwise, as viewed in FIGS. 6 and 9, about the axis of the pin 146, one or the other of the springs 110, 250 will be compressed depending on whether the disconnect member 180 is in what will be termed its "connecting" position or its "disconnecting" position. In FIGS. 5–7, the disconnect member 180 is in its connecting position wherein it provides a driving connection between the handle 130 and the bolt 90. When the disconnect member 180 is in its connecting position, the bolt 90 is caused to retract rightwardly in the passage 70 as the handle 130 pivots out of its nested position, as is shown in FIGS. 6 and 7. In FIGS. 1–3 and 8–10, the disconnect member 180 is in its disconnecting position. When the disconnect member 180 is in its disconnecting position, it provides no driving connection between the handle 130 and the bolt 90 whereby, when the handle 130 is pivoted about the axis of the pin 146, no corresponding movement of the bolt 90 takes place.

As is seen in FIGS. 3, 6 and 9, the operating arm 142 is normally spaced from the left end surface 100 of the slot 96. The spacing between the slot end surface 100 and the operating arm 142 provides a lost motion connection which permits the bolt 90 to be retracted, i.e. moved rightwardly in the passage 70, without requiring corresponding pivotal movement of the handle 130. This feature is desirable because it provides the lock 20 with a capability to be "slammed" to bring the bolt 90 into latching engagement with a suitably configured strike (not shown) without causing the handle 130 to pivot out of its nested position.

Figure 10:
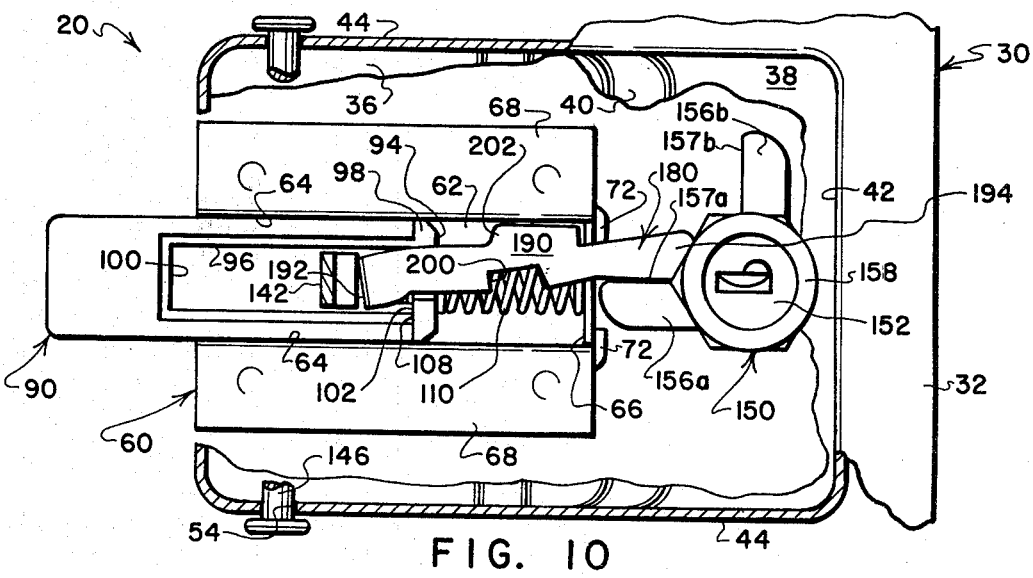
FIG. 10 is a front side elevational view similar to FIG. 8 with the components of the lock being positioned as shown in FIG. 9.
Figure 11:
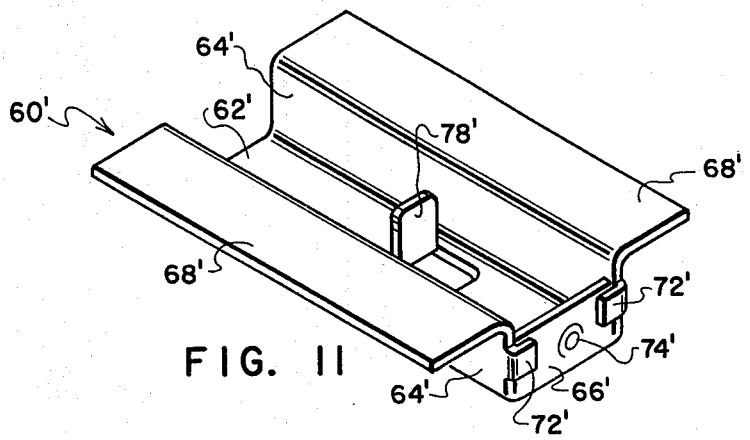
FIG. 11 is a perspective view of an alternate slide bolt housing used in the preferred practice of the present invention; and, FIGS. 12, 13 and 14 are sectional views similar to FIGS. 3, 6 and 9 showing corresponding positions of lock components in a lock employing the slide bolt housing of FIG. 11.
Figure 12:
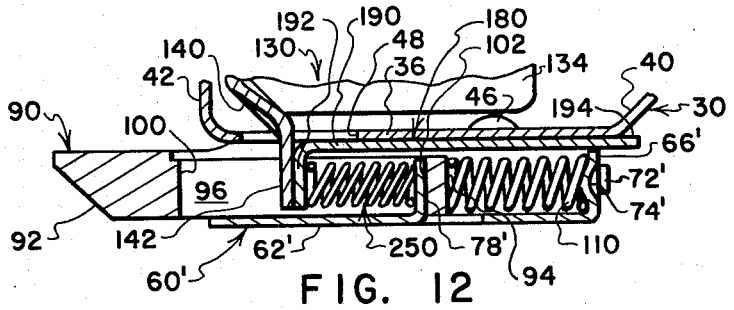
Figure 13:
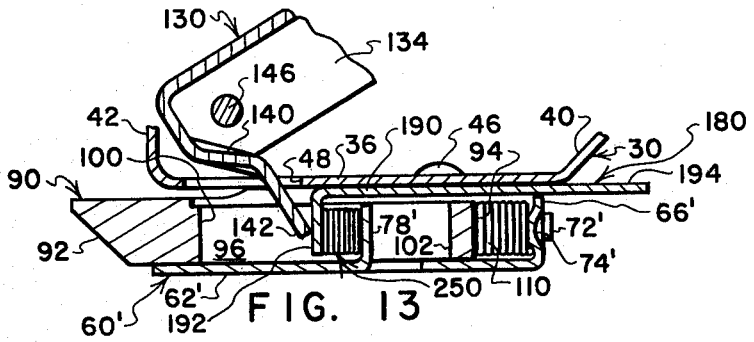
Figure 14:
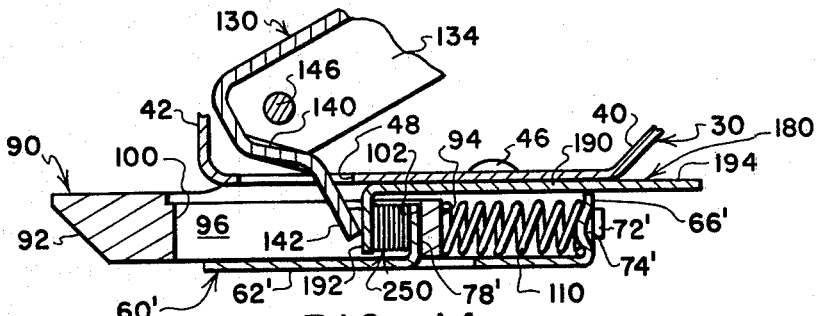

The key control 150 includes a lock cylinder 152 into which a key 154 may be inserted. The key 154 is configured to cooperate with tumblers housed within the cylinder 152 to permit a locking member 156 to be rotated between locked and unlocked positions. The locking member 156 carries a pair of arms **156*a*, 156*b* which extend substantially orthogonally relative to each other. The arms 156*a*, 156*b* have side surfaces 157*a*, 157*b* which extend substantially radially with respect to the axis of rotation of the locking member 156. The unlocked position of the locking member 156 is shown in FIGS. 1–3 and 5–7. The locked position of the locking member 156 is shown in FIGS. 8–10**.

The cylinder 152 is provided with an enlarged head 158 and a threaded body 160. A pair of flats 162 are formed on opposite sides of the threaded body 160. The cylinder 152 is positioned with its head 158 engaging the forward surface of the right body portion 38, with its body 160 extending through the hole 50, and with its flats 162 engaging the flat surfaces 52. A locknut 164 is threaded onto the body 160 to hold the cylinder 152 in place on the lock body 30.

While the key control 150 is of a conventional, commercially available type, it is selected from among various commercially available key controls which have particular operational characteristics. These operational characteristics should include key removal capability when the locking member 156 is positioned in either of its locked and unlocked positions. A further characteristic of the key control 150 is that, once the locking member 156 has been positioned in either of its locked or unlocked positions and the key 154 has been removed from the cylinder 52, the key control 150 maintains the locking member 156 in such position.

Referring to FIG. 4, the disconnect member 180 has an elongate, flat central section 190 which terminates in a downwardly turned left end 192 and a rounded right end 194. One side of the central section 190 is provided with a notch 196 having an abutment surface 200 at its left end. The other side of the central section 190 is provided with a projection 202. The projection 202 is configured to lie alongside the inner surface of one of the bolt housing side walls 64 when the disconnect member 180 is in its disconnect position, as shown in FIG. 9. The central portion 190 is slidably received between the bolt housing end wall 66 and the lock body back wall portion 36, and extends along the upper side of the bolt 90. The left end 192 depends into the bolt slot 96. The right end extends toward the key control 150.

When the locking member 156 is in its unlocked position as shown in FIGS. 2, 3, 5 and 6, the side **157*b* of the locking member arm 156*b* engages the end 194 of the disconnect member 180 and shifts it laterally with respect to the bolt passage 70 to a connecting position where, as is best seen in FIGS. 5 and 7, the abutment surfaces 108, 200 engage to provide a driving connection between the bolt 90 and the disconnect member 180. When the disconnect member 180 assumes its connecting position as shown in FIG. 5, pivotal movement of the handle 130 from its nested position, shown in FIG. 3, to its operating position, shown in FIG. 6, will cause the disconnect member 180 to move rightwardly carrying with it the bolt 90, as shown in FIGS. 6 and 7. Stated in another way, when the locking member 156 is in its unlocked position as shown in FIG. 5, the disconnect member 180 is positioned such that a driving connection is established between the handle 130 and the bolt 90. Under these circumstances, movement of the handle 130 to its operating position will cause corresponding retracting movement of the bolt 90, as is illustrated in FIGS. 6 and 7**.

When the locking member 156 is in its locked position as shown in FIGS. 8–10, the side **157*a* of the locking member arm 156*a* engages the end 194 of the disconnect member 180 and shifts it laterally with respect to the bolt passage 70 to a position where, as is best seen in FIG. 8, the abutment surfaces 108, 200 are out of alignment and provide no driving connection between the disconnect member 180 and the bolt 90. When the disconnect member 180 assumes its disconnecting position, as shown in FIG. 8, pivotal movement of the handle 130 from its nested position to its operating position will cause the disconnect member 180 to move rightwardly without carrying with it the bolt 90, as is shown in FIGS. 9 and 10. Stated in another way, when the locking member 156 is in its locked position as shown in FIG. 8, the disconnect member 180 is positioned such that no driving connection is established between the handle 130 and the bolt 90. Under these circumstances, the handle 130 can be moved freely without causing any corresponding movement of the bolt 90, as is illustrated in FIGS. 9 and 10**.

One reason for the elongate character of the locking member arms **156*a*, 156*b* is to provide the lock 20 with a "slam" capability. Regardless of whether the disconnect member 180 is in its connecting or disconnecting position, if the tapered end 92 of the bolt 90 is slammed into engagement with a suitable striker plate (not shown), the bolt 90 will move rightwardly within the passage 70. The elongate character of the arms 156*a*, 156*b* permits the disconnect member 180 to move rightwardly with the bolt 90 without transmitting any forces to the locking member 156**.

Another reason for the elongate character of the locking member arms **156*a*, 156*b*, is to permit the disconnect member 180 to move rightwardly in response to pivotal movement of the handle 130, as occurs when the handle 130 is pivoted regardless of whether the lock 20** is "locked" or "unlocked".

Referring to FIGS. 3, 6 and 9, the compression coil spring 250 has a left end which engages the left end 192 of the disconnect member 180, and a right end which engages the right end wall 102 of the bolt slot 96. By this arrangement, the spring 250 biases the disconnect member 182 leftwardly relative to the bolt 90. The spring 250 also biases the handle 130 toward its nested position. The extension of the spring 250 is limited by the engagement of the left end 192 with the handle operating arm 142.

Referring to FIG. 3, the normal extended positions of springs 110, 250 are shown. Referring to FIG. 6, when the handle 130 is extended with the lock 20 "unlocked," the bolt projection spring 110 is compressed while the spring 250 remains substantially in its extended attitude. Referring to FIG. 9, when the handle 130 is extended with the lock 20 "locked," the spring 250 is compressed while the bolt projection spring 110 remains in its extended attitude.

Referring to FIGS. 11–14, in preferred practice, a slightly modified bolt housing 90' is substituted for the previously described bolt housing 90. The housing 90' is identical in all respects to the housing 90 except that the upwardly projecting stop formation 78' is taller than the stop formation 78. The numerals used to designate features of the housing 90 are repeated in designating corresponding features of the housing 90', but are provided with a "prime" mark to clearly show that a different bolt housing is being designated.

A difference which results from the use of the taller stop formation 78' is that the right end of the spring 250 engages the stop formation 78' instead of the bolt slot end wall 102. This difference causes the spring 250 to perform slightly differently in locks utilizing the housings 90, 90'. A lock which embodies the preferred bolt housing 90' is identical in all other respects to the described lock 20, and operates in substantially the same manner as previously described, except for the action of the spring 250. As will be seen from a comparison of FIGS. 3 and 12, the normal extended position of the spring 250 is much the same in both types of locks. As will be seen from comparing FIGS. 6 and 13, however, when the handle 130 is extended with the lock "unlocked," the spring 250 is compressed in the embodiment which employs the bolt housing 90' but not in the emmbodiment employing the housing 90. As will be seen from comparing FIGS. 9 and 14, when the handle 130 is extended with the lock "locked," the action of the spring 250 is essentially the same regardless of which of the bolt housings 90, 90' is employed. One reason the bolt housing 90' is preferred is due to a concern that the spring 250 might become "hung up" on the shorter stop formation 78 utilized in the housing 90. Another reason is that the stop 78' not only serves to limit the extending movement of the bolt 90, but also bears the load or force exerted by the spring 250, thereby enabling the spring 110 to be of lighter construction than is possible in the embodiment 90 where the springs 110, 250 both act in opposition to each other on the bolt 90.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A door lock, comprising:

(a) a body structure defining an elongate bolt-mounting passage therein;

(b) a bolt structure positioned at least partly in the passage for movement between latching and unlatching positions, the bolt structure having a connecting formation connected thereto for movement along a first path of travel within the passage in response to movement of the bolt structure between its latching and unlatching positions;

(c) a handle structure connected to the body structure for movement between normal and operating positions, the handle structure having an operating formation connected thereto for movement along a second path of travel within the passage in response to movement of the handle structure between its normal and operating positions;

(d) key control means connected to a selected one of the structures and having a locking member which is movable relative to the selected structure between locked and unlocked positions, the key control means being operable to selectively retain the locking member in its locked and unlocked positions;

(e) disconnect means interposed between the operating formation and the connecting formation for selectively drivingly connecting and disconnecting the operating and connecting formations to thereby selectively drivingly connect and disconnect the handle and bolt structures, the disconnect means including a disconnect member housed at least partly within the passage, and mounting means supporting:

(i) only a part of the disconnect member for movement within the passage along a third path of travel between connecting and disconnecting positions in response to movement of the locking member between its locked and unlocked positions; and, (ii) the entire disconnect member for movement along a fourth path of travel paralleling the length of the elongate passage in response to movement of the operating formation along the second path of travel;

(f) the disconnect means being operable:

(i) when the part of the disconnect member is in its connecting position, to drivingly connect the handle and bolt structures such that, when the handle structure is moved to its operating position, the bolt structure is caused to move to its unlatching position; and, (ii) when the part of the disconnect member is in its disconnecting position, to provide no driving connection between the handle and bolt structures, whereby the handle structure may be moved freely between its normal and operating positions and the disconnect member may be moved freely along the fourth path of travel without causing corresponding movement of the bolt structure; and, (g) the mounting means being operable to translatably mount the entire disconnect member for linear movement along the fourth path of travel longitudinally with respect to the passage, whereby the fourth path of travel is caused to take the form of a linear path, paralleling the length of the elongate passage, and the mounting means being operable to confine the third path of travel to directions extending substantially laterally of the linear fourth path of travel.

2. The door lock of claim 1 wherein the body structure includes a first housing member having wall portions including a back wall portion which cooperate to define a fowardly-facing recess, and a second housing member rigidly connected to the first housing member and cooperating therewith to a passage within which portions of the bolt structure and the disconnect member are housed.

3. The door lock of claim 1 additionally including structure defining a lost motion connection between the operating formation and the bolt structure for enabling the bolt structure to be moved from its latching position to its unlatching position without causing corresponding movement of the operating formation, whereby the bolt structure may be "slammed" into latching engagement with a suitably configured strike.

4. The door lock of claim 1 wherein the connecting formation includes an abutment surface formed on the bolt structure.

5. The door lock of claim 4 wherein the abutment surface comprises an end wall of an elongate slot formed in the bolt structure.

6. The door lock of claim 1 wherein the operating formation includes an abutment surface formed on the handle structure.

7. The door lock of claim 1 wherein:

(a) the handle structure is mounted on the body structure for pivotal movement about a mounting axis; and, (b) the operating formation is connected to the handle structure for pivotal movement about the mounting axis.

8. The door lock of claim 1 wherein the key control means is mounted on the body structure.

9. The door lock of claim 1 wherein the bolt structure comprises an elongate member mounted on the body structure for sliding movement relative to the body structure along a linear first path of travel extending longitudinally of the elongate member.

10. The door lock of claim 1 wherein the disconnect means includes an elongate disconnect member which overlies at least a portion of the bolt structure and extends in directions substantially parallel to the first path of travel.

11. The door lock of claim 1 wherein the operating formation is pivotally mounted on the body structure for movement along an arcuate second path of travel.

12. The door lock of claim 1 additionally including first biasing means interposed between the bolt and body structures for biasing the bolt structure toward its latching position.

13. The door lock of claim 12 additionally including second biasing means interposed between the disconnect member and the bolt structure for biasing the disconnect member into engagement with the operating formation.

14. The door lock of claim 12, additionally including second biasing means interposed between the disconnect member and the body structure for biasing the disconnect member into engagement with the operating formation.

15. A door lock, comprising:

(a) a body structure defining an elongate bolt-mounting passage;

(b) a bolt structure positioned at least partly in the passage for movement between latching and unlatching positions, the bolt structure having a connecting formation connected thereto for movement along a first path of travel located within the passage as the bolt structure moves between its latching and unlatching positions;

(c) a handle structure connected to the body structure for movement between normal and operating positions, the handle structure having an operating formation connected thereto for movement along a second path of travel located within the passage as the handle structure moves between its normal and operating positions;

(d) disconnect means interposed between the connecting formation and the operating formation, a first part of the disconnect means being movable along a third path of travel within the passage into and out of intersection with a selected one of the first and second paths of travel as at least a portion of the disconnect means moves between connecting and disconnecting positions, the first part of the disconnect means being operable:

(i) when the portion of the disconnect means is in its connecting position, to cooperate with the connecting and operating formations to drivingly connect the handle and bolt structures such that, when the handle structure is moved to its operating position, the bolt structure is caused to move to its unlatching position; and, (ii) when the portion of the disconnect means is in its disconnecting position, to provide no driving connection between the handle and bolt structures;

(e) the entire disconnect means being movable along a fourth path of travel paralleling the length of the elongate passage in response to movement of the operating formation along the second path of travel, the disconnect means being movable along the fourth path of travel:

(i) in conjunction with movement of the bolt structure along the first path of travel when the first part of the disconnect means is in its connecting position and the handle structure is moved to its operating position; and, (ii) independently of the bolt structure when the first part of the disconnect means is in its disconnecting position and the handle structure is moved to its operating position; and, (f) key-control means connected to one of the structures and being operable to move the portion of the disconnect means between its connecting and disconnecting positions and to selectively releasably retain the portion of the disconnect means in its connecting and disconnecting positions.

16. The door lock of claim 15 wherein the operating formation is pivotally mounted on the body structure such that the second path of travel is curved along its length.

17. The door lock of claim 15 wherein:

(a) a first abutment surface is defined on the operating formation;

(b) a second abutment surface is defined on the disconnect means; and, (c) the first and second abutment surfaces are configured to drivingly engage each other when (i) the portion of the disconnect member means is positioned in its connecting position and (ii) the handle structure is moved from its normal position to its operating position.

18. The door lock of claim 15 wherein the keycontrol means is mounted on the body structure.

19. The door lock of claim 15 wherein the bolt structure comprises an elongate member mounted on the body structure for sliding movement relative to the body structure along a linear first path of travel extending longitudinally of the elongate member.

20. The door lock of claim 15 wherein the bolt structure is provided with a formation which is engageable by the disconnect means when (i) the part of the disconnect means is in its connecting position and (ii) the handle structure is moved from its normal position to its operating position, the engagement between the bolt formation and the disconnect means being operable to effect movement of the bolt structure from its latching position to its unlatching position as the handle structure is moved from its normal position to its operating position.

21. A door lock, comprising:

(a) a body structure defining an elongate boltmounting passage;

(b) a bolt structure positioned at least partly in the passage for movement between latching and unlatching positions, the bolt structure having a connecting formation connected thereto and being movable along a first path of travel within the passage as the bolt structure moves between its latching and unlatching positions;

(c) a handle structure connected to the body structure for movement between normal and operating positions, the handle having an operating formation connected thereto and being movable along a second path of travel within the passage as the handle structure moves between its normal and operating positions;

(i) when the disconnect member portion is in its connecting position, to cooperate with the connecting and operating formations to drivingly connect the handle and bolt structures such that, when the handle structure is moved to its operating position, the bolt structure is caused to move to its unlatching position; and, (ii) when the disconnect member portion is in its disconnecting position, to provide no driving connection between the handle and bolt structures;

(e) key-control means connected to one of the structures and having a locking member movable between locked and unlocked positions, the key-control means being operable:

(i) when the locking member is in its unlocked position, to position the disconnect member portion in its connecting position; and, (ii) when the locking member is in its locked position to position the disconnect member portion in its disconnecting position;

(f) the disconnect means additionally including guide means mounting at least a segment of the disconnect member for movement along a fourth path of travel within the passage in response to movement of the handle structure between its normal and operating positions such movement along the fourth path of travel being in conjunction with movement of the bolt structure along the first path of travel when the disconnect member portion is in its connecting position, and being relative to the bolt structure when the disconnect member portion is in its disconnecting position; and, (g) the first, second and fourth paths of travel extending within the passage substantially parallel to each other and lying in a substantially common plane, and the third path of travel extending substantially laterally within the passage with respect to at least one of the first and second paths of travel.

22. The door lock of claim 21 wherein the body structure includes a first housing member having wall portions including a back wall portion which cooperate to define a forwardly-facing recess, and a second housing member rigidly connected to the first housing member and cooperating therewith to define a passage within which portions of the bolt structure and the disconnect member are housed.

23. The door lock of claim 21 wherein a selected one of the locking member and the disconnect member is provided with an elongate formation which cooperates with an interfitting formation provided on the other of these members, the elongate formation and the interfitting formation being configured to permit movement of the disconnect member segment along the fourth path of travel without transmitting forces to the locking member.

24. The door lock of claim 23 wherein the elongate formation is provided on the locking member, and the interfitting formation is provided on the disconnect member.

25. The door lock of claim 21 wherein:

(a) the bolt structure is provided with a formation which is engageable by the disconnect member when the handle structure is moved from its normal position to its operating position while the disconnect member is in its connecting position; and, (b) the engagement between the bolt formation and the disconnect member is operable to effect movement of the bolt structure from its latching position to its unlatching position as the handle structure is moved from its normal position to its operating position.

26. The door lock of claim 25 wherein:

(a) the bolt formation includes a transversely extending shoulder; and, (b) the disconnect member is provided with an abutment formation which is movable into and out of alignment with the shoulder as the disconnect member is moved between its connecting and disconnecting positions.

27. The door lock of claim 21 wherein a first biasing means functions to bias the bolt structure toward its latching position, and a second biasing means functions to bias the handle structure toward its normal position.

28. The door lock of claim 27 wherein the first biasing means is interposed between the body and bolt structures.

29. The door lock of claim 27 wherein the second biasing means is interposed between the bolt structure and the disconnect member.

30. The door lock of claim 27 wherein the second biasing means is interposed between the body structure and the disconnect member.

31. The door lock of claim 21 wherein:

(a) the bolt structure has a receiving formation formed therein defining an abutment surface; and, (b) the body structure carries a stop formation which engages the abutment surface when the bolt structure is in its latching position.

32. A door lock comprising:

(a) a body structure defining an elongate bolt-mounting passage thereon;

(b) a bolt structure positioned at least partly in the passage for movement along a first path of travel between latching and unlatching positions;

(c) a handle structure connected to the body structure for movement between normal and operating positions;

(d) an operating formation connected to the handle structure for movement within the passage in response to movement of the handle structure between its normal and operating positions, the movement of the operating formation following a second path of travel;

(e) disconnect means interposed between the operating formation and the bolt structure, and including a disconnect member positioned at least partly within the passage and being movable between connecting and disconnecting positions, the disconnect means being operable:
(i) when the disconnect member is in its connecting position to intersect the first and second paths of travel to drivingly connect the handle and bolt structures such that, when the handle structure is moved to its operating position, the bolt structure is caused to move to its unlatching position; and,
(ii) when the disconnect member is in its disconnecting position, to provide no driving connection between the handle and bolt structures;
(f) key-control means connected to one of the structures and including a locking member movable between locked and unlocked positions, the key-control means being operable:
(i) when the locking member is in its unlocked position, to position the disconnect member in its connecting position; and,
(ii) when the locking member is in its locked position, to position the disconnect member in its disconnecting position; and,
(g) the disconnect member being movable in two distinctly different modes within the passage, one mode being in response to movement of the locking member and the other mode being in response to movement of the handle structure, the movement of the disconnect member in said other mode being in conjunction with movement of the bolt structure along the first path of travel when the disconnect member is in its connecting position, and being relative to the bolt structure when the disconnect member is in its disconnecting position.

33. The door lock of claim 32 wherein a structure providing a lost motion connection connects the operating formation and the bolt structure for enabling the bolt structure to be moved from its latching position to its unlatching position without causing corresponding movement of the operating formation.

34. The door lock of claim 32 wherein:
(a) biasing means operates to bias the disconnect member into engagement with the operating formation; and,
(b) the guide means mounts the disconnect member for translation along a third path of travel as the operating formation moves along the first path of travel.

35. The door lock of claim 34 wherein the first, second and third paths of travel extend, at least in part, along a common path portion.

36. A flush-mountable door lock, comprising:
(a) a body structure having side and back walls which cooperate to define a forwardly-facing recess, having an opening formed through the back wall, and having structure defining a bolt-mounting passage;
(b) an elongate bolt structure slidably supported on the body structure at a location behind a portion of the back wall, the bolt structure being movable within the passage along a path of movement between a projected position wherein the bolt structure is extended with respect to the body structure, and a retracted position wherein the bolt structure is retracted with respect to the body structure, the bolt structure having a receiving formation communicating with the back wall opening;
(c) a handle structure mounted on the body structure and being movable between a nested position wherein the handle structure is nested within the recess, and an operating position;
(d) key-control means carried by the body structure and a locking member movable between locked and unlocked positions;
(e) connecting means carried by the handle structure and being movable therewith, the connecting means extending through the back wall opening, into the passage and into the receiving formation of the bolt structure;
(f) disconnect linkage means positioned at least partly in the passage, having a first portion extending into the receiving formation for engaging the connecting means, and having a second portion extending longitudinally of the bolt structure toward the key-control means, at least a part of the disconnect linkage means being movable transversely with respect to the path of movement of the bolt structure between a connecting position wherein it is operable to drivingly interconnect the handle and bolt structures such that when the handle structure is moved out of its nested position the bolt structure is caused to retract, and a disconnecting position wherein no driving connection is provided between the handle and bolt structures;
(g) the disconnect linkage means being movable longitudinally with respect to the path of movement of the bolt structure:
(i) in conjunction with movement of the bolt structure when the first portion is in its connecting position and the handle structure is moved out of its nested position; and,
(ii) relative to the bolt structure when the first portion is in its disconnecting position and the handle structure is moved out of its nested position; and,
(h) the locking member being engageable with the second portion of the disconnect linkage means for moving the disconnect linkage means to its connecting position when the locking member is moved to its unlocked position, and for moving the disconnect linkage means to its disconnecting position when the locking member is moved to its locked position.

37. The door lock of claim 36 wherein the key-control means is mounted on the body structure.

38. The door lock of claim 36 wherein the locking member is rotatably mounted for movement between its locked and unlocked positions.

39. The door lock of claim 38 wherein the key-control means is mounted on the body structure and has a rotatable cylinder which supports the locking member for rotation.

* * * * *

UNITED STATES PATENT AND TRADEMARK OFFICE

CERTIFICATE OF CORRECTION

PATENT NO. : 4,335,595

DATED : June 22, 1982

INVENTOR(S) : Swan et al.

It is certified that error appears in the above-identified patent and that said Letters Patent are hereby corrected as shown below:

Column 7, line 41, delete "52" and substitute --152--

Column 7, line 52, delete "disconnect" and substitute --disconnecting--

Claim 21, after the end of subparagraph "c)" insert --d) disconnect means interposed between the operating formation and the bolt structure and including a disconnect member, the disconnect member housed at least partly in the passage having at least a portion which is movable along a third path of travel within the passage into and out of at least one of the first and second paths of travel between connecting and disconnecting positions, the disconnect means being operable:--

Signed and Sealed this

*Eleventh* Day of *January 1983*

[SEAL]

*Attest:*

GERALD J. MOSSINGHOFF

*Attesting Officer*

*Commissioner of Patents and Trademarks*